United States Patent [19]

Kolman

[11] 4,055,057

[45] Oct. 25, 1977

[54] COUPLING DEVICE FOR THE OPPOSED ENDS OF BRACELETS

[76] Inventor: Anita M. Kolman, 527 Ramona St., Wilmette, Ill. 60091

[21] Appl. No.: 702,537

[22] Filed: July 6, 1976

[51] Int. Cl.[2] ..... A44C 5/00

[52] U.S. Cl. ..... 63/7; 224/4 E

[58] Field of Search ..... 63/3, 7, 8, 4; 24/201 BN, 201 HE, 201 S, 225, 230.5 S, 243 J, 263 SB; 224/4 E

[56] References Cited

U.S. PATENT DOCUMENTS

| | | | |
|---|---|---|---|
| 444,673 | 1/1891 | Roehr | 63/4 X |
| 1,738,106 | 12/1929 | Kuehner | 63/4 |

FOREIGN PATENT DOCUMENTS

| | | | |
|---|---|---|---|
| 491,630 | 9/1918 | France | 63/2 |
| 322,275 | 1/1903 | France | 63/4 |

*Primary Examiner*—F. Barry Shay
*Attorney, Agent, or Firm*—Edward R. Lowndes

[57] ABSTRACT

A coupling device for the opposed ends of bracelets and similar articles of jewelry of the type employing spring rings and associated eyelets and particularly for two-part bracelets the arcuate halves of which are rigid and connected in end-to-end fashion by a laterally inflexible hinge which maintains them at all times, whether the bracelets are open or closed, in coplanar relationship. Forward entry of the spring ring into its associated eyelet by a wedge action, reinforcement of substantially the entire length of the spring ring plunger by the eyelet to resist rearward or tensional uncoupling of the bracelet parts, and functional and decorative concealment of both the spring ring and its associated eyelet to prevent accidental retraction of the spring ring plunger constitute the principal features of the coupling device.

9 Claims, 19 Drawing Figures

COUPLING DEVICE FOR THE OPPOSED ENDS OF BRACELETS

The improved coupling device comprising the present invention has been designed primarily for use in connection with a two-part bracelet which consists of two 180° arcuate bracelet halves, hingedly connected together in end-to-end fashion by a laterally inflexible hinge which maintains such halves substantially coplanar at all times so that as the bracelet approaches its fully closed condition, the free ends thereof are constrained to meet each other in end-to-end relationship. The invention is however not limited to such use and, if desired, coupling devices embodying the principles of the present invention may be associated with flexible link or chain type bracelets, as well as with a wide variety of other articles of jewelry having opposed ends designed to be releasably secured together.

Heretofore, in connection with two-part bracelets of the type briefly outlined above wherein the hinge connection between the two bracelet parts is inflexible in a transverse direction so as to maintain the two parts aligned for closure purposes, and which for convenience of description will hereinafter be referred to as "rigid hinge" bracelets, the use of spring rings has not been considered practical for coupling purposes and few, if any, such bracelets are currently upon the market. The use of a spring ring at one free end of a rigid hinge type bracelet and a cooperating eyelet at the other free end presents numerous problems and, as a result, various other types of clasps have been favored.

One of the principal objections to the use of a spring ring is connection with a rigid hinge type bracelet resides in the weakness of the plunger which is associated with the spring ring and its tendency to become misaligned when tension is applied to coupling so that the eyelet will escape from the spring ring. Another objection resides in the difficulty involved in effecting the coupling and uncoupling operations, it being necessary in either instance to retract the spring ring plunger appreciably more than one-half its extent before an entry throat which is sufficiently wide as to admit the eyelet into the spring ring, or to allow for its exit can be attained. An additional limitation that is attendant upon the use of a spring ring for bracelet closure purposes resides in the overhang and consequent exposure of the plunger-actuating finger nail knob which frequently catches on articles of clothing or other adjacent objects and causes inadvertent retraction of the plunger and consequent unfastening of the clasp with possible loss of the bracelet. The loss of the bracelet, even an inexpensive costume bracelet is undesirable, but when it is considered that some bracelets may have an intrinsic value running in the hundreds of dollars, it is not surprising that manufacturers of rigid hinge bracelets avoid the use of spring ring and eyelet connections.

A further and serious limitation that is attendant upon the use of a spring ring for bracelet fastening purposes resides in the unsightly appearance of the spring ring and its associated eyelet. Especially with highly ornamental bracelets having considerable surface ornamentation, such as jewel insets, etched or other symbols, high or bas relief designs and the like, a spring ring and its associated eyelet would destroy the continuity of the bracelet design and this is another reason why spring rings are looked upon with disfavor by bracelet manufacturers.

Thus, in connection with so-called costume bracelets of the less expensive variety, a great preponderance of such bracelets are equipped with push-in latch type clasps wherein a reentrant spring fold is forced into a rectangular opening until it snaps into a locked position. Removal is effected by pinching the reentrant fold to release the latching action. On some of the more expensive bracelets, a wide variety of special clasps which are commonly referred to as wire clasps and involved interlocking hook-like members are employed. At the risk of repetition, few, if any, bracelets are equipped with spring ring clasps.

The present invention is designed to overcome the above-noted limitations that are attendant upon the use of spring rings for bracelet fastening purposes and, toward this end, the present invention contemplates the provision of a two-part rigid hinge type bracelet which employs a spring ring at one of its free ends and a cooperating eyelet as its other free end, and in which the eyelet is integrally constructed by a molding operation during formation of its associated bracelet part, the eyelet presenting a forward outside overhang which is generally of wedge shape cross section so that it presents a thin knife-like forward outside edge and a relatively broad rear inside edge. By such an arrangement, the wedge shaped overhang facilities entry of the eyelet into the confines of the spring ring so that it is not necessary to completely retract the plunger of the spring ring to create a wide entrance mouth for the eyelet. As soon as the forward knife edge locates the partially opened mouth of the spring ring, closing pressure on the two-part bracelet will automatically force the entire wedge-like overhang into the spring ring so that automatic projection of the spring ring plunger will complete the union.

An important feature of the invention resides in the fact that the wedge-like overhang substantially fills the circular spring ring opening so that after the union is made there is very little circumferential lost motion or looseness between the opposed ends of the two bracelet parts. Another and equally important feature of the invention resides in the provision of a pair of enlargements on opposite sides of the wedge-like overhang, such enlargements serving to a large degree to conceal the spring ring or, at least, to render its presence less noticeable so that it will not detract from any overall design which may be applied to the outer side of the bracelet. Toward this end, the enlargement may be ornamental in its nature, as for example in the form of a bulge or ball which is not unduly noticeable by reason of the provision of other similar bulges or balls which are provided near the free ends of the bracelet parts to provide a cluster of enlargements which is not inconsistent with the overall surface ornamentation of the bracelet.

In a modified form of the invention, a slightly different form of coupling device has been illustrated wherein the same concealment of the spring ring and its associated eyelet has been maintained but in which the free edges of the two bracelet sections meet in substantially edge-to-edge relationship. Also the aforementioned wedge-shaped portion of the bracket section which carries the eyelet is still retained but it does not overhang the adjacent free end of the bracelet section but, instead, it lies wholly beneath such free end and on the inner side of the bracelet where it is completely concealed from view, such free end substantially completely overlying such eyelet and its wedge-shaped portion. The extreme free end of such bracelet section terminates in a linearly straight transverse edge which mates substantially in edge-to-edge fashion with a similar linearly straight transverse edge on the extreme free end of the other bracelet section so that there is no gap between the two sections when they are closed upon each other but, instead only a thin line of juncture is presented. The spring ring is partially embedded in the other bracelet section but the gap portion thereof projects forwardly of the linearly straight edge and thus, when it is coupled to the eyelet, it also is concealed along with the eyelet through which it passes. The coupling device of this modified form of the invention is therefore substantially entirely concealed insofar as an outside view of the bracelet is concerned.

In a third illustrated form of bracelet, the same mechanical features of the invention are retained but the ornamental or camouflaging of the bracelet seam have been eliminated.

The provision of a coupling device such as has briefly been outlined above, and possessing the stated advantages, constitutes the principal object of the present invention. Numerous other objects and advantages of the invention, not at this time enumerated, will become readily apparent as the nature of the invention is better understood.

In the accompanying several sheets of drawings forming a part of this specification, several illustrative embodiments of the invention has been shown.

Figure 1:
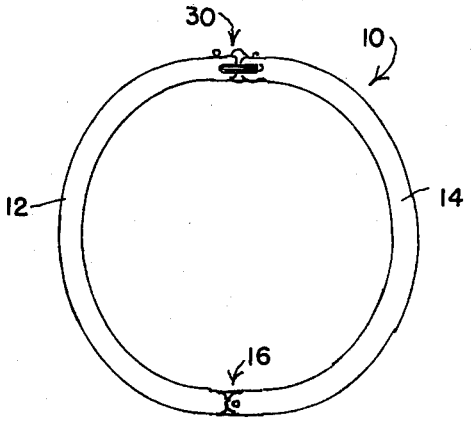
FIG. 1 is a side elevational view of a bracelet embodying the novel clasp of the present invention and showing the same in its closed or fastened condition.
Figure 2:
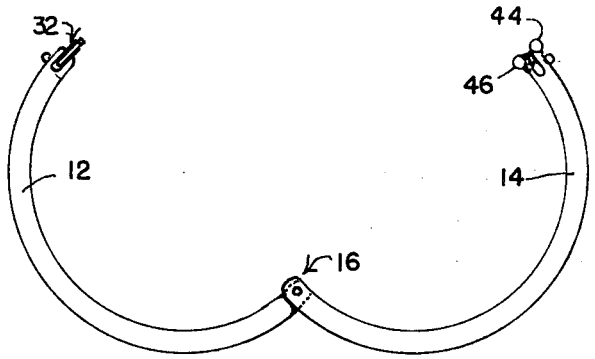
FIG. 2 is a side elevational view, similar to FIG. 1, showing the same in its open or unfastened condition.
Figure 3:
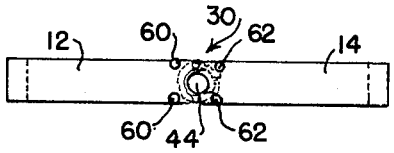
FIG. 3 is a top edge view of the structure shown in FIG. 1.
Figure 4:
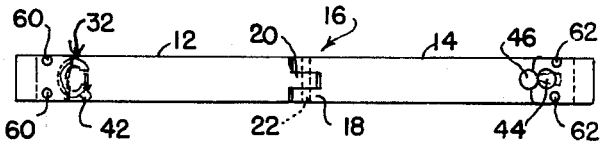
FIG. 4 is a top view of the structure shown in FIG. 2.

Referring now to the drawings in detail and in particular to FIG. 1 to 4 inclusive, a bracelet embodying the improved clasp of the present invention is designated in its entirety by the reference numeral 10 and it is comprised of two halves or sections 12 and 14 which are operatively connected together in end-to-end fashion by means of a conventional hinge arrangement 16 including a hinge bifurcation 18 on the section 14, a hinge ear 20 on the section 12 and a hinge pin 22 which maintains the ear 20 within the bifurcation 18. The sections 12 and 14 are movable relative to each other between the fully open position of the bracelet in which they are shown in FIG. 2 and the fully closed position of the bracelet in which they are shown in FIG. 1 wherein the bracelet as a whole constitutes a closed generally circular structure. Actually, the bracelet when in its closed position, is not truly circular but, instead, it is roughly elliptical with the individual sections 12 and 14 being curved to fit the wrist portion of a user as is customary with most bracelets.

It is to be noted at this point that by reason of the particular hinge structure illustrated herein the two curved bracelet halves or sections 12 and 14 are capable of being swung in the same plane. In other words they are maintained substantially coplanar in all positions thereof. Actually it is not intended that there shall be any lateral inclination of either section relative to the other and, for convenience of description herein such hinge structure will be hereinafter referred to as a rigid hinge connection so as to distinguish it from certain swivel hinge connections or other hinge connections where lateral inclination between adjacent bracelet sections is made possible. However, due to manufacturing tolerances, the hinge connection may not be truly rigid and, under certain circumstances, it will allow for a very limited misalignment of the two sections although, in general, when the two free end regions of the bracelet are brought together they will be substantially aligned for effective union by means of the novel coupling device of the present invention.

Considering now the coupling device or clasp of the present invention, such clasp is designated in its entirety by the reference numeral 30 and it includes a conventional spring ring 32 (see particularly FIGS. 6 and 8) and a cooperating eyelet 34, the spring ring 32 being carried by the bracelet section 12 and the eyelet 34 being molded in the bracelet section 14.

Insofar as the spring ring 32 is concerned such ring is purely conventional and is in the form of a composite assembly including a curved arcuate outer tubular sheath portion 36 on the order of 320° and within which there is slidable an arcuate plunger 38. The plunger is spring biased outwardly of the tubular sheath section 36 by means of a compression spring 40 and a fingernail tab 42 is carried by the plunger and projects radially outwardly through the slot 40 for plunger manipulation purposes. Normally the spring 40 maintains the plunger 38 extended so that it closes the gap which exists between the opposed ends of the tubular section 36 but when the tab 42 is pulled circumferentially of the sheath section 36, the projecting portion of the plunger is withdrawn into such section, thus opening the spring ring so that the eyelet 34 may be moved into circumferential register with the plunger, after which release of the tab 42 will allow the plunger to be shifted to its fully extended position, pass through the eyelet, and lock the eyelet and spring ring together, all in a manner that is well-known in the art. A wide variety of spring rings are available commercially for use in connection with the present invention, one such ring being manufactured and sold by Julius Forrester, Inc. of New York City, and no claim is made herein to any novelty associated with the spring ring 42, the novelty of the present invention residing rather in the manner in which such spring ring is associated with its respective bracelet part 12, in the manner in which the eyelet 34 is provided in the part 14, the nature of the eyelet itself, and the manner in which both spring ring and eyelet are substantially concealed from view so that their presence, when the clasp is in its closed condition, is unnoticeable or, at least, does not detract from the continuity of the bracelet design, and in which the spring ring 32 and eyelet 34 cooperate with each other to afford ease of assembly and separation, and unusual resistance of the spring ring to distortion when tension is applied to the bracelet clasp, all in a manner that will be made clear presently.

Figure 5:
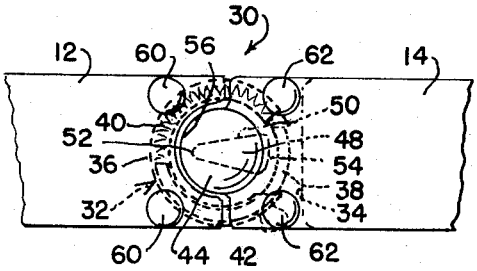
FIG. 5 is an enlarged fragmentary outside plan view of the closed clasp and its associated free end regions of the bracelet.
Figure 6:
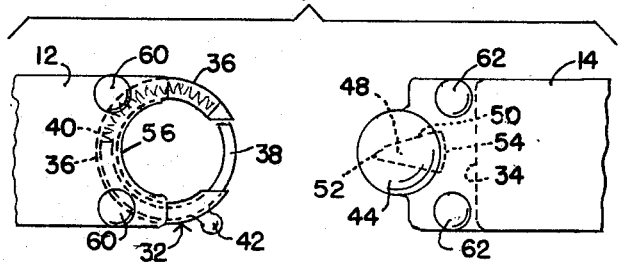
FIG. 6 is an outside plan view, similar to FIG. 5, showing the spring ring and eyelet portions of the clasp juxtapositioned relative to each other preparatory to effecting closure of the clasp.
Figure 7:
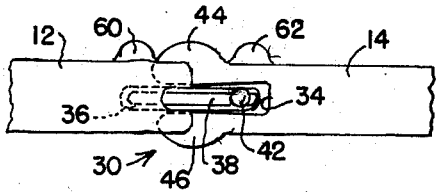
FIG. 7 is a bottom plan view of the structure shown in FIG. 5.

Referring now particularly to FIGS. 5, 6 and 7, the spring ring 32 is applied to the free end of the bracelet part 12 by a suitable molding operation at the time such part is initially cast and in such a manner that approximately one-half of the spring ring is embedded in the metal of the part, the other half of the spring ring projecting forwardly from the free end of the part 12 as best seen in FIG. 6. The projecting portion of the spring ring includes limited opposed end portions of the tubular outer section 36, together with the portion of the plunger 38 which normally closes the gap between such opposed end portions.

Figure 8:
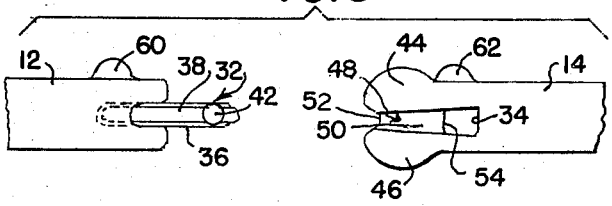
FIG. 8 is a bottom plan view of the structure shown in FIG. 6.
Figure 9:
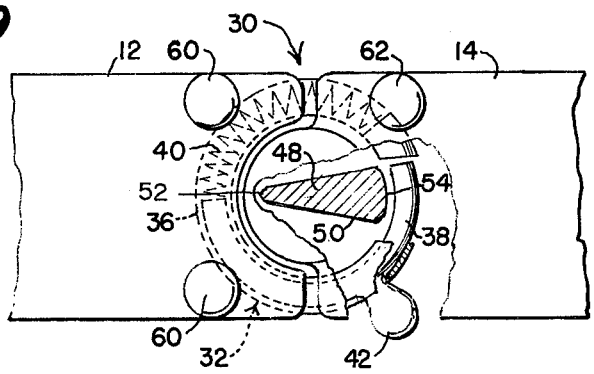
FIG. 9 is an enlarged fragmentary outside plan view, similar to FIG. 5, with certain portions broken away to more clearly reveal the nature of the invention.
Figure 10:
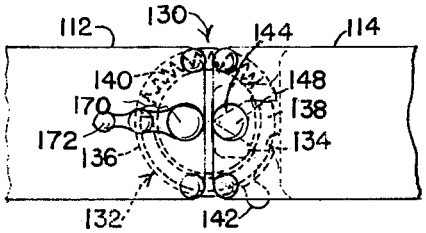
FIG. 10 is a fragmentary outside plan view, similar to FIG. 5, but showing a slightly modified form of bracelet clasp.
Figure 11:
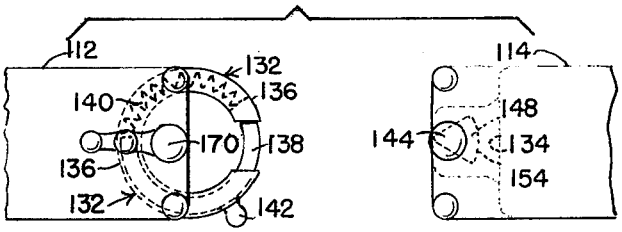
FIG. 11 is an outside plan view similar to FIG. 10, showing the spring ring and eyelet portions of the clasp juxtapositioned relative to each other preparatory to effecting closure of the clasp.
Figure 12:
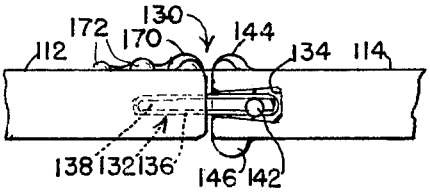
FIG. 12 is a side elevational view of the structure shown in FIG. 10.
Figure 13:
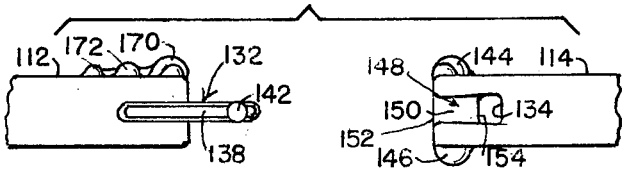
FIG. 13 is an bottom plan view, similar to FIG. 12, showing the spring ring and eyelet portions of the clasp juxtapositioned preparatory to effecting closure of the clasp.
Figure 14:
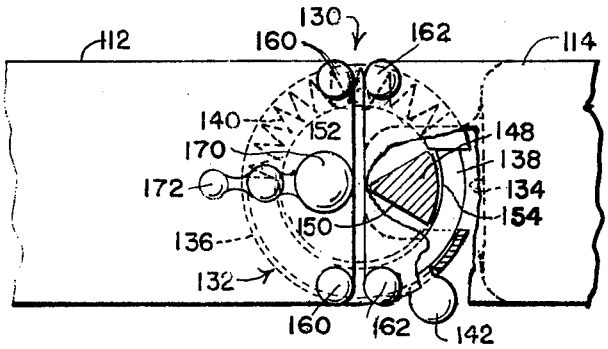
FIG. 14 is an enlarged fragmentary view, similar to FIG. 10, with certain parts broken away in the interests of clarity.

Insofar as the eyelet 34 is concerned, such eyelet is created during initial molding of the part 14. The eyelet 34 is in the form of a transverse bore which extends transversely through the free end region of the part 14 while an appreciable amount of metal is disposed forwardly of the eyelet as best shown in FIGS. 6 and 8. Such forwardly disposed metal is in the form of an outer hump or half ball 44 and an inner hump or half ball 46, the two humps being separated by a reduced portion 48 which is triangular in cross section. Such triangular portion establishes a continuous groove around the medial region of the forwardly disposed metal, the groove having converging sides 50 (see also FIG. 9) which meet to provide a relatively sharp forward edge 52, and a relatively long rear transverse side 54. Preferably, the continuous groove is arcuate in transverse cross section for a reason that will be made clear subsequently. Stated otherwise, the eyelet is disposed inwardly of the extreme free end of the section 14 a distance substantially equal to the diameter of the spring ring and the metal which exists forwardly of the eyelet is of a bulbous nature as shown in FIG. 8 and, except for the generally triangular wedge shaped groove 50, it substantially occupies the entire central confines of the spring ring.

It has previously been stated that the spring ring 32 is partially embedded in the free end region of the part 12. It is to be noted however from an inspection of FIG. 6 that such free end region is recessed or cut away as indicated at 56 on both the outer and the inner sides of the bracelet part 12 so that there will be no diametric obstruction of metal which would prevent full entry of the projecting portion of the part 14 including the reduced wedge shaped portion 48 and the two half-balls 44 and 46 from entering the confines of the spring ring 32.

Apart from certain ornamental features of the present invention which will be described subsequently, the functional aspects of the clasp 30 have been fully set forth above. In the operation of the clasp, when it is desired to bring the clasp parts together in order to close the bracelet about the wrist of the wearer for example. The spring ring 32 will be opened in the usual manner by applying the fingernail to the tab 42 and causing the spring ring plunger 38 to become retracted at least partially into the tubular section 36 so as to create a gap in the spring ring which is sufficiently wide as to receive the forward end or edge 52 of the wedge-like reduced portion 48. Thereafter the entire metal portion forwardly of the eyelet 34 and including the wedge-like reduced portion and the two humps or half balls 44 and 46 is moved into the confines of the spring ring 32 to bring the bracelet to its fully closed condition, after which the tab 42, now released, will allow the plunger 38 to snap to its fully extended position under the influence of the spring 40, thereby locking the clasp in its retaining position.

It is to be noted at this point that if the fingernail tab 42 is fully retracted, the wedge shaped portion 48 will move easily into the confines of the spring ring 32. However, it is not essential that the user take great pains to insure a fully retraction of the plunger 38. If for example the plunger is retracted to a sufficient extent as to allow the sharp tip edge of the wedge portion 48 to enter the spring ring, manual forcing of the bracelet parts or halves 12 and 14 toward each other will by a wedging action, force the plunger against the action of the spring 40 so that the entire wedge portion eventually will enter the confines of the spring ring. For example, if after an initial partial entry of the wedge shaped portion 48 into the confines of the spring ring 32 has been effected, the fingernail slips away from the tab 42 (as it frequently does in connection with spring ring and eyelet combinations) the wedging action set forth above will complete the locking action of the clasp 30 so that no repetitious hunting to effect registry of the eyelet with the spring ring is necessary.

It is to be particularly noted that after full entry of the wedge-shaped portion 48 into the confines of the spring ring 32 has been completed, the broad expanse of the transversely curved rear transverse side 54 of the portion 48 will remain substantially coextensive with the exposed portion of the plunger 38, thereby lending full support to the latter instead of merely making a point or line support as is the case with conventional spring ring and eyelet combinations. This allows for an appreciably greater degree of tensional radial expansion of the bracelet as a whole without distorting the plunger 38 and creating an undesirable escape opening for the eyelet 34. It is also to be noted that the wedge portion 48 fills a major portion of the inner confines of the spring ring 32 while the two half-balls 44 and 46 substantially fill the remainder of the space within the confines of the spring ring, not only reducing lost motion or looseness between the parts 12 and 14 to a minimum but also decoratively concealing the presence of the spring ring. Further concealment or "camouflaging" of the clasp 30 as a whole may be effected by the placement of additional humps or half balls 60 on the free end region of the bracelet part 12 and additional half balls 62 on the free end region of the bracelet part 14 so as to provide a ball cluster consisting of the five half balls 44, 60, 62 which, appearancewise, serves to camouflage or conceal the juncture or seam. Finally, additional concealment of the presence of the clasp is attained by causing the fingernail tab 42 to lie almost entirely within the marginal confines of its adjacent bracelet edge as clearly shown in FIG. 5. Despite its lack of lateral projection from the side of the bracelet, it still remains accessible to the fingernail due to the void which is established by the eyelet 34.

In FIGS. 10 to 14 inclusive, a slightly modified form of the invention has been illustrated. Due to the similarity between the previously described bracelet clasp 30 and the modified form of bracelet clasp 130 shown in FIGS. 10 to 14, and in order to avoid needless repetition of description, similar characters of reference but of a higher order have been applied to the corresponding parts as between the disclosures of FIGS. 3, 5, 6, 7 and 8 and the disclosures of FIGS. 10 to 14 inclusive.

In the modified form of bracelet clasp 130, the eyelet 134 is set back further from the straight end edge of the bracelet section 134 than is the eyelet 34 and, also, the two bracelet sections are provided with linearly straight free edges which are contiguous when the clasp 130 is in its closed condition. The wedge shaped reduced portion 148 lies immediately behind the transverse edge of the section 114 and its inside surface 154 substantially bridges the distance between the opposed free ends of the tubular sheath portion 136 of the spring ring 132 when the clasp is closed so that there is no lateral shifting or play between the substantially meeting free edges of the bracelet. The half-balls or humps 144 and 146 remain in vertical alignment with the reduced wedge-shaped portion 148 and thus they also lie inside the free edge of the bracelet section 114. In order to match the half-balls or humps 144 appearancewise, a similar hump 170 is applied to the bracelet section 112. The humps 144 and 170, together with smaller additional half-balls or humps 172 which are applied to the bracelet section 112, are provided mainly for camouflage purposes to detract from the appearance of the bracelet seam. The fact that the free edges of the bracelet sections 112 and 114 substantially meet, and that the inside edge 154 of the wedgeshaped reduced portion 148 substantially spans the opposed edges of the spring ring sheath 136, eliminates any appreciable amount of lost motion between the clasp parts when the latter are closed upon each other.

In FIGS. 15 through 19, a further modified form of bracelet clasp 230 has been illustrated and again, due to similarity of parts and in order to avoid needless repetition of description, similar reference numerals but of a still higher order have been applied to the corresponding parts as between the disclosures of FIGS. 10 through 14 and FIGS. 15 through 19. In this latter form of the bracelet clasp 230, which may be regarded as a preferred form, the functional features of the bracelet 130 remain substantially the same as the previously described modified form, the principal difference residing in the fact that the clasp portion of the bracelet section 214 is provided with two undercuts or recesses 247 (FIGS. 18 and 19) on the inner side of the free end of the bracelet section 214, such recesses establishing the wedge-shaped portion 248 which is designed for forcible entry into the confines of the spring ring 232 as previously described in connection with the wedge-shaped portions 48 and 148. Physically and functionally, the bracelet section 212 remains substantially the same as the bracelet section 212 except for the fact the surface ornamentation or camouflaging such as the humps or half-balls 160, 170 and 172 have been omitted. Likewise, surface ornamentation similar to that shown at 144, 146 has been omitted from the bracelet section 214.

Figure 15:
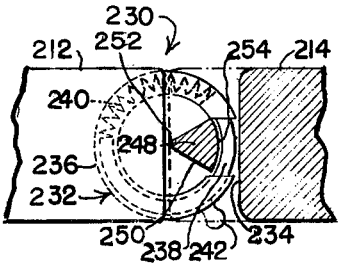
FIG. 15 is a fragmentary outside plan view, similar to FIG. 10, showing a further modified form of bracelet clasp.
Figure 16:
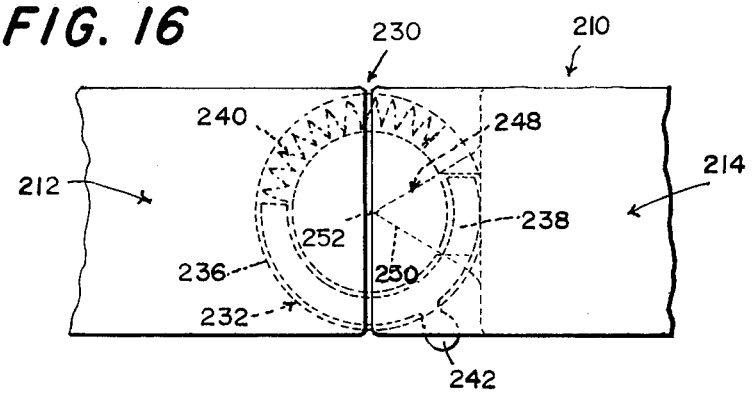
FIG. 16 is an enlarged fragmentary plan view, similar to FIG. 15, the view being completed and without sectioning.
Figure 17:
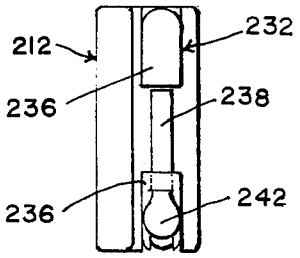
FIG. 17 is an end view of one of the bracelet sections shown in FIG. 16, the view being taken in the direction of the arrows associated with the line 17—17 of FIG. 19.
Figure 18:
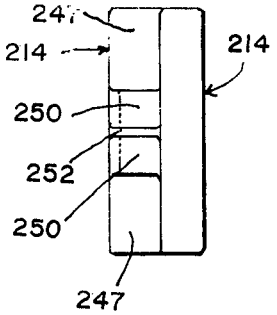
FIG. 18 is an end view of the other bracelet section, the view being taken in the direction of the arrows associated with the line 18—18 of FIG. 19.
Figure 19:
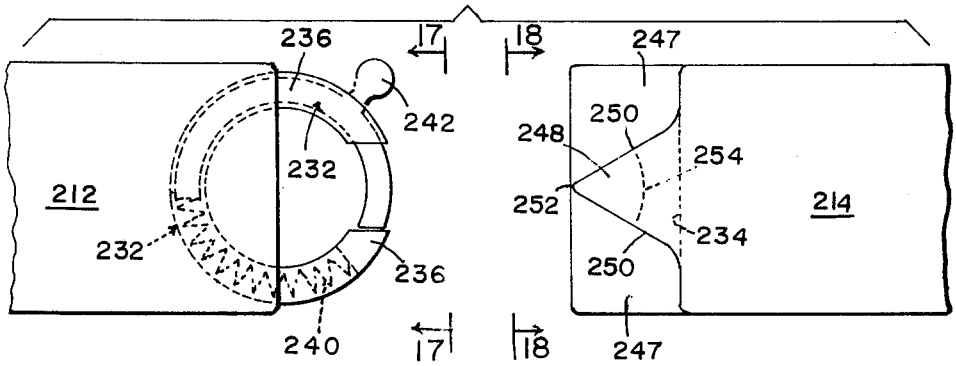
FIG. 19 is an enlarged view, similar to FIG. 6, showing the spring ring and eyelet portions of the bracelet clasp of FIG. 15 juxtapositioned relative to each other preparatory to effecting closure of the clasp.

It is to be noted from an inspection of FIG. 15 that when the two bracelet clasp sections or parts are in their closed condition, the wedge 248 is confined at its inside corners, the rear side of the wedge being straddled by the opposed ends of the tubular sheath 232. The meeting edges of the two bracelet sections maintain this relationship so that there is practically no side slip of the sections in the vicinity of the seam.

The invention is not to be limited to the exact arrangement of parts shown in the accompanying drawings or described in this specification as various changes in the details of construction may be resorted to without of the invention. For example, the clasp concealing aspects which are offered by the provision of the outer half-ball 44 which substantially fills the confines of the spring ring 33 may be varied by the use of other enlargements, as for example square, rectangular or other polygonal enlargements. The particular design aspects of the enlargements 60 and 62 are not considered part of the present invention, but the functional aspect of the enlargement 44 is to be considered a feature of the invention inasmuch as it substantially fills the confines of the spring ring 32 and reduces lost motion or looseness to a minimum as previously described. Therefore, only insofar as the invention has particularly been pointed out in the accompanying claims is the same to be limited.

Having thus described the invention, what I claim and desire to secure by Letters Patent is:

1. The combination with a bracelet consisting of first and second generally semi-circular relatively rigid sections hingedly connected in end-to-end fashion for swinging movement toward and away from each other between an open position wherein the free end regions thereof are separated, and a closed position wherein such ends are disposed in end-to-end coupled contiguity, coupling means for releasably maintaining said free end regions in their coupled relationship, said coupling means comprising a spring ring including an arcuate outer tubular sheath fixedly carried by the free end region of said first section and having opposed spaced apart ends establishing an entry gap, an arcuate plunger slidable in said sheath and movable between a retracted position wherein said gap is exposed and a projected position wherein the plunger substantially closes the gap, and a spring disposed within said sheath and yieldingly urging the plunger to its projected position, a transverse bore extending through the free end region of the second section inwardly of the extreme free end of such section and establishing an eyelet for reception of the plunger, the material of said second section forwardly of said bore being of a bulbous nature, being integral with such section, and substantially filling the internal confines of of said spring ring when said plunger is projected through said transverse bore so that the sections are coupled, said bulbous portion being formed with a narrow groove on each lateral side thereof to facilitate entry of the bulbous portion of the second section into the confines of said spring ring when the plunger is at least partially retracted.

2. The combination set forth in claim 1, wherein said narrow grooves taper toward each other whereby said bulbous portion is generally of wedge shape in the medial region thereof.

3. The combination set forth in claim 2, wherein the bulbous portion is also formed with a narrow groove along its inner side and which is substantially coextensive with the projecting portion of the plunger when the sections are coupled.

4. The combination set forth in claim 3, wherein said tubular sheath is partially embedded in the material of the free end region of said first bracelet section so that its end regions extend forwardly of said latter bracelet section.

5. The combination set forth in claim 4, wherein said bracelet sections are in the form of ribbon-like castings and the extreme free end of said first bracelet casting is recessed on an arcuate bias to conform to the curvature of the tubular sheath which is partially embedded therein, thereby exposing the circular inside contour of the spring ring.

6. The combination set forth in claim 5, wherein the width of said bracelet sections is substantially equal to the overall diameter of said spring ring.

7. The combination set forth in claim 6, wherein said plunger is formed with a radially extending fingernail tab which, for the most part, normally lies within the lateral confines of the bracelet.

8. The combination with a bracelet consisting of first and second semi-circular sections hingedly connected together in end-to-end fashion for swinging movement toward and away from each other between an open position wherein the free end regions thereof are separated, and a closed position wherein such free end regions are disposed in coupled contiguity, said bracelet sections being in the form of narrow rigid ribbon-like castings, said free end regions terminating in transverse edges which, when the bracelet is in its closed position, substantially abut each other coextensively so as to provide a transverse seam, of coupling means for releasably maintaining said free end regions in their coupled relationship, said coupling means comprising a spring ring including an arcuate outer tubular sheath having the central portion thereof embedded in the free end region of said first section and having forwardly projecting opposed spaced apart ends establishing an entry gap, an arcuate plunger slidable in said sheath and movable between a retracted position wherein said gap is exposed and a projected position wherein the plunger substantially closes said gap, and a spring within said sheath and yieldingly urging the plunger to its projected position, a transverse bore extending through the free end region of the second bracelet section inwardly of the extreme free end of such section and establishing an eyelet for reception of the plunger, the material of said second section immediately forwardly of said bore being of a transverse width slightly less than the distance between the spaced apart ends of said sheath whereby, when said plunger is projected through said bore, said spaced apart ends straddle such material of the second section and thus inhibit lateral shifting movement between the meeting ends of the two bracelet sections.

9. The combination set forth in claim 8, wherein the material of said second section forwardly of said bore is provided with sides which are inclined relative to each other and afford an entry wedge for passage between said opposed ends of the sheath.

* * * * *